United States Patent [19]

Marsh et al.

[11] 4,068,601

[45] Jan. 17, 1978

[54] FOLDING TABLE CONSTRUCTION

[75] Inventors: Ronald W. Marsh, Michigan City, Ind.; Grant M. Newbury, Shawano, Wis.

[73] Assignee: Pullman Incorporated, Chicago, Ill.

[21] Appl. No.: 720,020

[22] Filed: Sept. 2, 1976

[51] Int. Cl.[2] ..... A47B 3/00

[52] U.S. Cl. ..... 108/134; 108/152; 248/240; 403/100

[58] Field of Search ..... 108/134, 48, 136, 152; 292/277, 278, 263, 338; 248/240; 403/100, 102, 106; 182/187

[56] References Cited

U.S. PATENT DOCUMENTS

| | | | |
|---|---|---|---|
| 859,454 | 7/1907 | Larsson | 108/134 |
| 1,984,602 | 12/1934 | Snyder | 108/134 X |
| 2,014,549 | 9/1935 | Behm | 108/134 X |
| 2,035,411 | 3/1936 | Udell | 403/100 |
| 2,483,899 | 10/1949 | Grasso et al. | 108/134 |
| 2,577,399 | 12/1951 | Bell | 108/134 X |
| 2,843,436 | 7/1958 | Franks | 108/134 |
| 2,965,399 | 12/1960 | Rizzuto | 403/100 |
| 3,113,533 | 12/1963 | Snow | 108/134 |
| 3,368,423 | 2/1968 | Fazekas et al. | 292/263 X |
| 3,563,592 | 2/1971 | Preston | 292/263 |

FOREIGN PATENT DOCUMENTS

| | | | |
|---|---|---|---|
| 1,374,007 | 8/1964 | France | 403/100 |

*Primary Examiner*—James T. McCall
*Attorney, Agent, or Firm*—Thomas G. Anderson

[57] ABSTRACT

A wall mounted folding table movable from a collapsed and recessed position includes a folding bracket arrangement having first and second arms pivotally interconnected and pivotally connected to the table top and to the wall structure. The foldable bracket includes a reciprocating latch which releasably connects the folding bracket members in a linear support position and also maintains the folding leg in a collapsed and recessed position.

10 Claims, 7 Drawing Figures

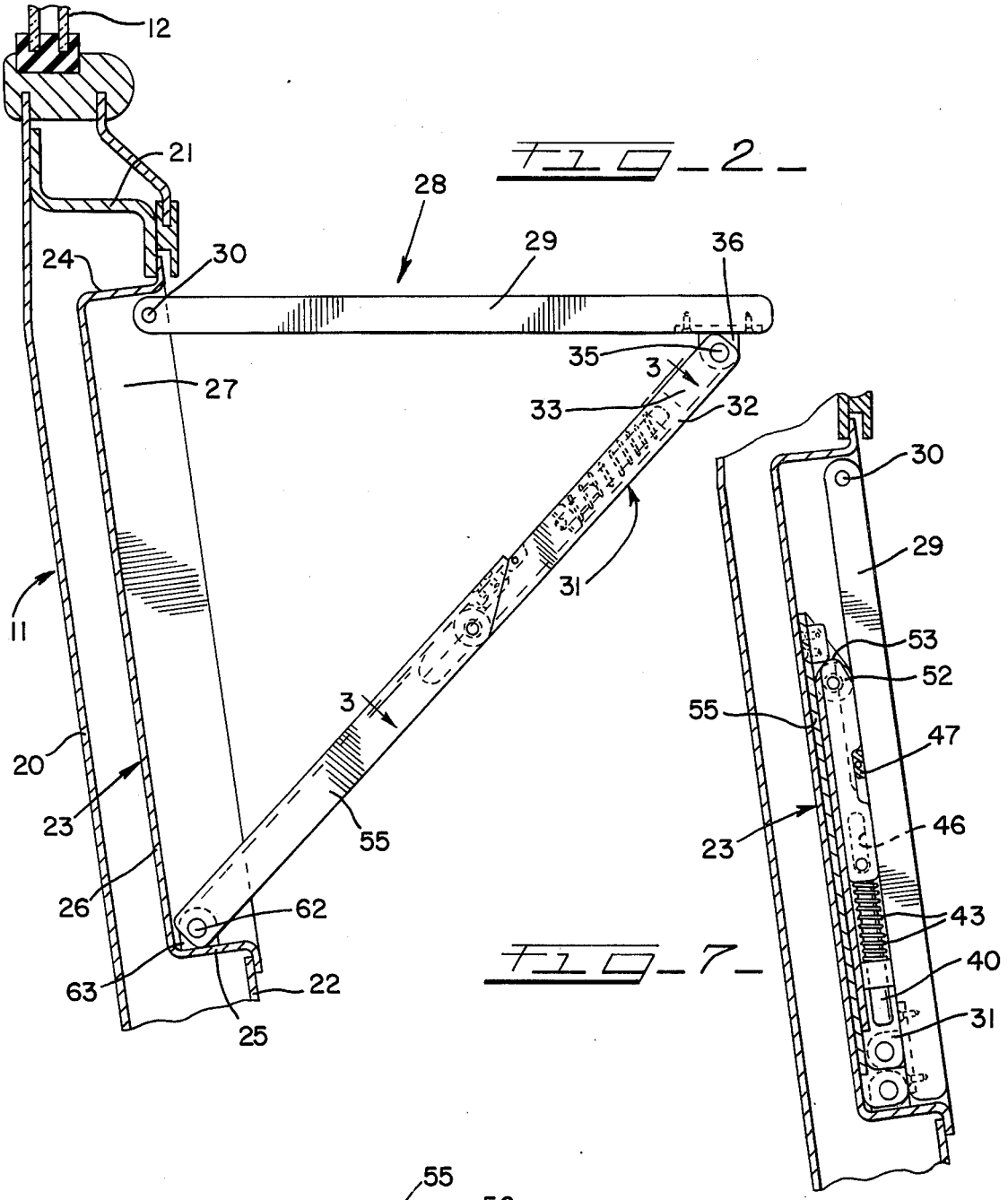
FIG. 2
FIG. 7
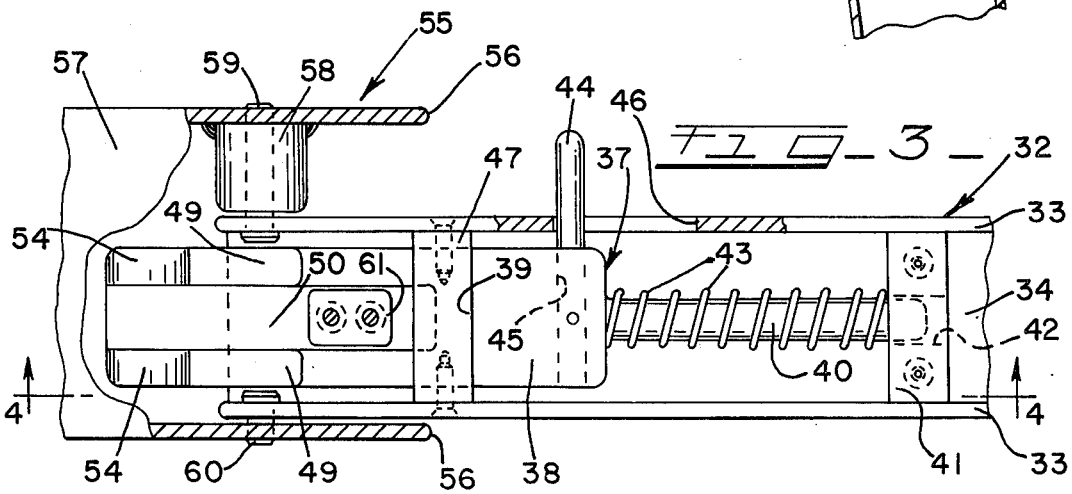
FIG. 3

FOLDING TABLE CONSTRUCTION

BACKGROUND OF THE INVENTION

1. Field of the Invention

The present improvement relates to foldable table constructions and more specifically to the type which are wall mounted and adapted to be placed into a recessed collapsed position.

2. Description of the Prior Art

The present invention which is primarily concerned with a wall mounted folding table includes a foldable bracket which may be jackknifed from a substantially linear support position to a collapsed position when the table top is stored in non-use position. Constructions of this type, in the prior art, include folding legs which are designed to maintain the same in the linear use position and which also are collapsible to a stored position. Various latch mechanisms have been employed to permit the folding of the legs and to maintain them in the stored position. The present improvement relates to a novel arrangement wherein a latch mechanism may be manually reciprocated so that the leg may be collapsed, the said latch mechanism being effective to raise and maintain the table top in its use position.

SUMMARY OF THE INVENTION

The type of wall mounted folding table of the present invention is particularly adapted to railway passenger car compartments wherein the passenger may desire to have quick access to a table which also can be conveniently raised and collapsed as desired. The invention includes a table top and folding leg arrangement which is stored within a recessed compartment provided in an outer wall of the railway car. The table top forms the cover enclosing the storage compartment and a folding leg arrangement comprises upper and lower legs or brackets which are hingedly interconnected so as to have a jackknife collapsing movement when the table top is stored. The upper and lower legs of the folding bracket are respectively connected to the table top and to a hinge bracket provided in the compartment. A reciprocating spring biased latch is movable longitudinally to extend from the upper bracket into engagement with the lower bracket in overlapping relation so that in the extended or linear position of the folding bracket the latch maintains the table in a use position. The latch may be moved so that the upper and lower legs are easily collapsed or restored to the use position. When the table is again placed into the use position the operator merely pulls outwardly on the table top whereupon at a certain location of the upper and lower legs or bracket members the latch members and spring arrangement serves to again place the table top in the horizontal or use position.

BRIEF DESCRIPTION OF THE DRAWINGS

FIG. 2 is a cross sectional view through a portion of a railway passenger car side wall disclosing a storage compartment for a folding table with the wall mounted table placed in a use position;

FIG. 3 is a cross-sectional view taken substantially along the line 3—3 of FIG. 2;

FIG. 7 is a cross-sectional view through a storage compartment showing the wall mounted table in a collapsed position therein.

DESCRIPTION OF THE PREFERRED EMBODIMENT

Figures 1, 4, 5, 6:
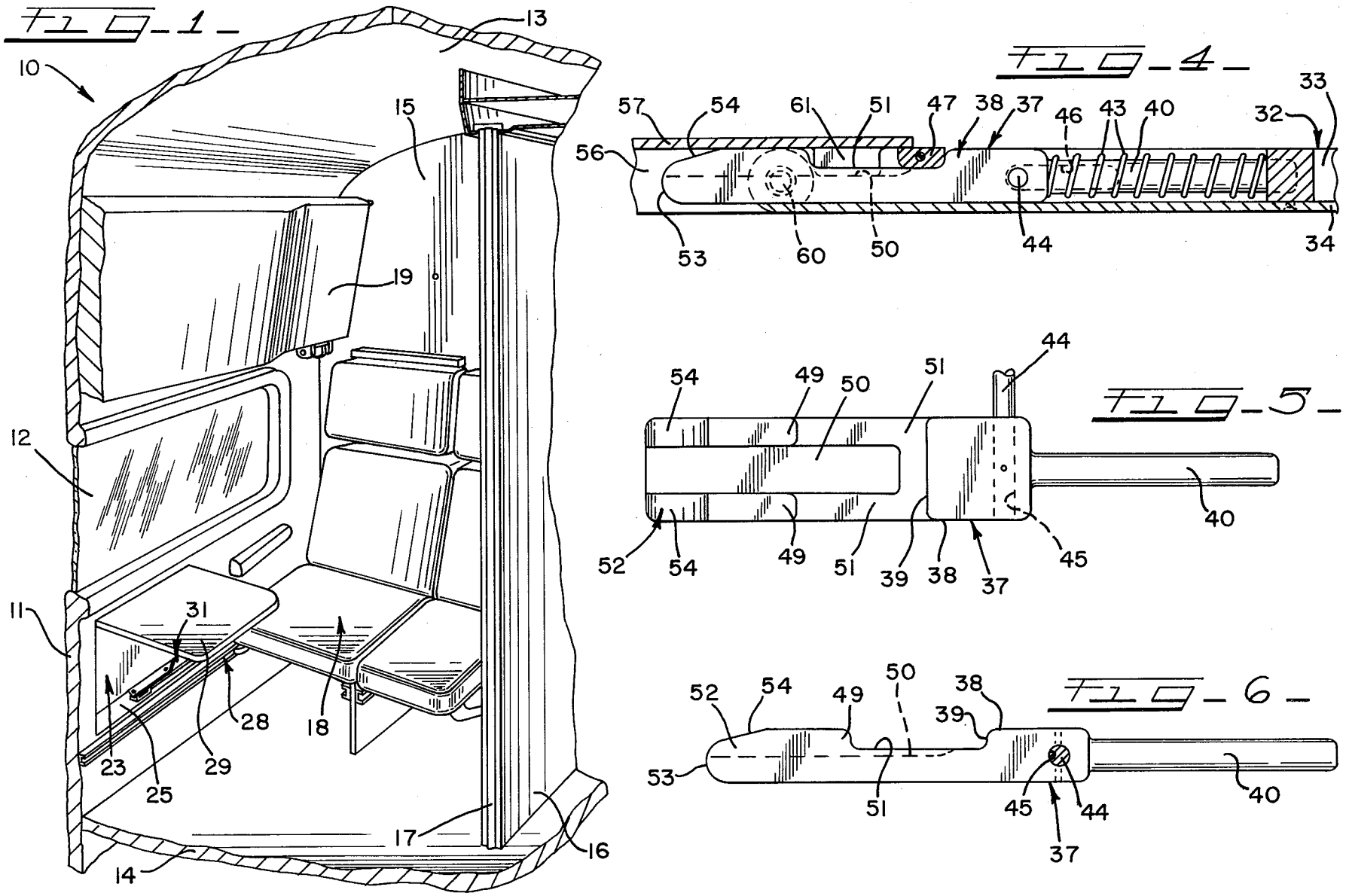
FIG. 1 is a perspective view of a portion of a railway passenger compartment showing a folding table in use position.
FIG. 4 is a cross-sectional view taken substantially along the line 4—4 of FIG. 3.
FIG. 5 is a plan view showing in detail a latching member.
FIG. 6 is a side elevational view of the latching member shown in FIG. 5.

Referring now particularly to FIG. 1, a railway passenger compartment 10 comprises a side wall 11 having a window 12 contained therein. The compartment 10 includes a car roof 13 and a car floor 14. Approximately only one-half of the compartment is shown in FIG. 1, the other half being substantially identical. The compartment 10 includes a pair of partition walls 15, only one of which is shown. The partition walls 15 are interconnected by means of a longitudinally extending divider wall 16 provided with a door and door opening generally designated at 17. The compartment also includes passenger seating arrangements 18 which are disposed in opposed relation only one of said arrangements being disclosed. A conventional type of upper berth 19 which is disclosed in a stored position may be lowered for accommodating one of the passengers when placed in a use or sleeping position.

The side wall 11 comprises an outside panel 20 connected to a horizontally extending wall stringer 21, a number of such stringers, supporting an inside wall panel 22. A pan shaped storage compartment 23 is supported by the stringer 21 and panel 22 and comprises an upper wall 24, a lower wall 25, a rear wall 26 and side walls 27.

FIGS. 1, 2 and 7, disclose a wall mounted table 28 comprising a table top 29 which by means of pivot or hinge members 30 is hingedly supported on the side walls 27 of the storage compartment 23. A folding or collapsible bracket 31 includes an upper first bracket member or leg 32 of channel shaped construction which includes side flanges 33 and a web 34. The upper bracket member 32 is hingedly connected to the outer most end of the table top 29 by means of a hinge pin 35 supported on a hinge bracket 36 suitably connected to the underneath side of the top 29. The upper bracket 32 supports a latch member generally designated at 37 which include a rectangular head or stop member 38 as best shown in FIGS. 3, 4, 5, and 6. The stop member 38 includes a stop engaging edge 39 on one side and has projecting therefrom on an opposite side a longitudinally extending rod 40. The rod 40 is slidingly supported on a guide member 41, supported on the upper bracket member 32 and extends into a bore 42 therein. A coil spring 43 is held captive between the stop member 38 and the guide member 41. A handle 44 supported within a base 45 at the latch member 37 projects outwardly therefrom.

As best shown in FIG. 3, one of the sides 33 of the channel shaped upper bracket member 32 is provided with an elongated slot 46. A strap or flat type of stop 47 is suitably connected to the upper edges of the flanges 33 and is engaged by the stop engaging edge 39 of the latchmember 37.

As best shown in FIGS. 3, 4, 5, and 6, the latch member 37 also is provided at one end thereof with raised vertical wall portions 49 laterally spaced to form an elongated groove or depressed channel portion designated at 50. The said one end of the latch member 37 includes extensions 52 of the wall portions 49 which at their extreme ends are provided with rounded end portions 53. The rounded end portions 53 having cam-like profiles that merge with a diagonally extending portion 54 of the wall portion extensions 52. As best shown in FIG. 6, the vertical wall portions 49 also include depressed or undercut surfaces 51 which as shown in FIG. 4, are engaged and support in sliding relation the flap stop 47 of the first bracket member 32.

Referring now particularly FIGS. 2, 3, and 4, the lower or second channel shaped bracket 55 includes flanges 56 and a web 57. The bracket 55 is substantially wider than the upper bracket member 32. This permits the nesting of the brackets together when the folding bracket or leg are in the stored position. A hinge boss 58 is supported on one of the flanges 56 and projects inwardly with respect thereto. A hinge pin 59 pivotally connects the boss 58 and one of the flanges 33 of the upper bracket 32. A hinge pin 60 connects the other flange 33 to the other flange 56 of the bracket 55. A rectangular retaining lug 61 is supported on the web 57 and projects downwardly as indicated in FIG. 5, into the groove or depressed channel portion 50. The lug 61 prevents latch member 37 from protruding from the upper leg 32 when the stored position of FIG. 7. The lower end of the bracket 55, as best shown in FIG. 2 is hingedly connected within the compartment by means of a hinge pin 62 and bracket 63 in turn supported on the lower wall 25 of the compartment.

OPERATION

FIGS. 1 and 2, disclose the wall mounted folding table 28 in the use position within the compartment 10. In this position the latch member 37 as indicated in FIGS. 3 and 4, supports the folding bracket, including upper bracket member 32 and lower bracket member 55 from collapse, since the spring 43 biases the rectangular head 38 and its engaging edge 39 against the stop strap 47. Relative hinging of the upper and lower bracket members also is impossible at this point since the extension 52 including the rounded ends 53 and diagonal portions 54 are disposed to the left of or beyond the pivot pins 59 and 60, as indicated in FIG. 3, so that they in effect form with the two bracket members a rigid arm secured against hinging or bending movement. Supposing now that the passenger desires to place the table in a recessed or collapsed position within the compartment 23. He merely grasps the manual lever member 44 and pulls the head 38 to the right in FIG. 3, thereby collapsing the spring 43 with the rod 40 now extending through the bore 42. This action thereby moves the end of the rounded ends 53 of the extension 54 to the maximum distance of the slot 46 which now moves the rounded ends to the right of the pivot pins 59 and 60 and the brackets 32 and 55 can now jacknife or collapse. This is accomplished by pushing downwardly on the end of the table top 29 while the passenger has pulled the handle 44 to the release position in the slot 46. As the brackets 31 and 55 move in a jacknife relationship the rounded ends 53 of the latch member 37 slidingly engage the web 57 above the hinge pins 59 and 60 until the ends are in engagement with that portion of the web 57 to the right of the hinge pins shown in FIG. 3, whereupon the spring 43 then exerts a sufficient force to accelerate jacknife movement of the brackets and thus urges the table top 29 into the collapsed position. Thus the table top and brackets are now stored within the compartment and may again easily be removed.

To again remove the same, the passenger merely pulls outwardly on the table top 29 whereupon as shown in FIG. 7 the jacknife movement of the bracket members causes the rounded ends 53 to engage the web 57 of the bracket 55 thus again compressing the spring 43 until the rounded end portions 53 are slightly to the left of the pins 59 and 60 whereupon the latch member 37 again moves to the position shown in FIG. 4, snapping or biasing the table top again to its horizontal positon shown in FIG. 2.

Thus by the arrangement disclosed it is apparent that the design of the latch member 37 positively secures the table top 29 either in its closed or in its extended use position. The spring arrangement also serves to accellerate the erection an collapse of the table top.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A wall mounted table including a table top, means hingedly connecting said table top to a vertical wall for movement from a horizontally extending use position to a vertical non-use position substantially parallel to said wall, the improvement comprising;

a folding bracket construction including a first bracket member, and a second bracket member, means pivotally connecting said first bracket member to said table top, means pivotally connecting said second bracket member to said vertical wall, means pivotally connecting adjacent ends of said first and second bracket members whereby said folding bracket may be collapsed from a linear diagonal supporting position to a stored folded position in the non-use position of said table top, a latch arrangement for releasably maintaining said folding bracket in said linear diagonal position including, a latch member supported on said first bracket member for relative reciprocating sliding movement, first guide means on said second bracket member for guiding said latch member, said latch member having one end portion overlapping said second bracket member and engaging said second bracket member at a point laterally spaced to one side of said means pivotally connecting said adjacent ends of said first and second bracket members in the linear position of said folding bracket and thereby lock said bracket members against folding movement, manually operated means on said latch member for moving said latch members whereby said one end portion is laterally movable to another side of said pivotal means connecting said adjacent ends of said bracket members and is disengaged from said second bracket member whereby said folding bracket and table top may be moved to said collapsed position, said one end portion comprising a guided extension having a rounded edge, said one end portion and guided extension having spaced side wall portions providing a groove, said first guide means on said second bracket slidably engaging said groove in guiding relation, said first guide means on said second bracket comprising a boss projecting from said second bracket, said side wall portion of said extension having a concave upper surface, a first stop member on said latch member having a stop surface, a second stop member on said first bracket member engageable by said stop surface of said first stop in the linear position of said folding bracket, and said second stop member engaging said undercut surfaces of said side wall portion in sliding relation during reciprocating movement of said latch member.

2. The invention in accordance with claim 1, said manually operated means including a handle, and a guide slot on said first bracket, said handle projecting through said guide slot and limiting reciprocating movement of said latch member.

3. A wall mounted table including a table top and means connecting the table top to a vertical wall for movement from a horizontal use position to a vertical, non-use position, the improvement comprising:

folding bracket means including a first bracket member and a second bracket member;

first support means connecting said first bracket member to said table top;

second support means connecting said second bracket member to said vertical wall;

said bracket members having overlapping portions;

hinge means pivotally connecting said first and second bracket members at said overlapping portions whereby said second bracket members may by rotated from an upright stored position to an aligned, diagonal supporting position as limited by said overlapping portions of the bracket members;

latch means for releasably maintaining said folding bracket means in said aligned, diagonal supporting position;

said latch means including a spring biased latch member supported for relative reciprocal, sliding movement;

guide means on one of said bracket members;

said latch member having one end portion and having means adapted to receive said guide means;

said latch member being movable to a first position with said one end portion overlapping an associated bracket member for engaging same beyond said hinge means for locking said bracket members against folding movement and maintaining in said supporting position;

said latch member being movable to a second position with said one end portion withdrawn from said associated bracket member sufficiently to permit folding of the bracket members;

said latch member being movable to a third position with said one end portion in abutting contact with the first guide means when the table top is in the vertical, non-use position; and said latch member including spring means urging said latch member to dispose one end portion of said latch members into engagement with the guide means when the bracket members are in the non-use position for holding the same in said non-use position.

4. The invention of claim 3, wherein:

said one end portion of the latch member having a cam-like profile, said profile being engageable with one of said bracket members during movement of said table between the horizontal, use position and the vertical, non-use position to accommodate jacknife movement of the bracket members.

5. The invention of claim 3, wherein said guide means includes:

a guide block;

said aligning means adapted to receive said guide means comprising a slot having flanking side wall means adapted to embrace the guide block to provide controlled sliding movement of the latch member.

6. The invention of claim 3, wherein the first guide means comprises:

first and second engageable cooperating means on said latch and said folding bracket means providing contacting surfaces for controlling movement of the guide block during said reciprocal, sliding movement.

7. The invention of claim 3, wherein said latch means includes:

guide rod means;

control means having means to receive the guide rod means to provide for reciprocal sliding movment of the latch member;

said spring means being reactive between said control means and the latch member.

8. The invention of claim 3, and:

said latch member having an undercut portion open to said other bracket member in the non-use position;

said undercut portion providing stop shoulders at the ends thereof;

stop means, on said other bracket member adapted to nest within the undercut portion of the latch member, and being engageable with said stop shoulder to limit movement of the latch member and thereby maintain the latch member in its then functioning position.

9. The invention of claim 3, wherein:

said bracket means includes a pair of channel shaped members each having side flanges connected by web means;

each web means having an unequal length to thereby space apart the associated side flanges to allow nesting of one channel shaped member within the other and to provide an opening between adjacent side flanges;

said hinge means having boss means in said opening for positioning the channel shaped members.

10. The invention according to claim 3, and said one end portion having a cam surface engageable with said guide means for camming said bracket members to a folded non-use position.

* * * * *